US012060623B2

(12) United States Patent
Yabu et al.

(10) Patent No.: US 12,060,623 B2
(45) Date of Patent: Aug. 13, 2024

(54) HIGH-STRENGTH STEEL SHEET WITH EXCELLENT DUCTILITY AND HOLE-EXPANDABILITY

(71) Applicant: NIPPON STEEL CORPORATION, Tokyo (JP)

(72) Inventors: Shohei Yabu, Tokyo (JP); Koutarou Hayashi, Tokyo (JP); Akihiro Uenishi, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 914 days.

(21) Appl. No.: 17/040,891

(22) PCT Filed: Mar. 30, 2018

(86) PCT No.: PCT/JP2018/013704
§ 371 (c)(1),
(2) Date: Sep. 23, 2020

(87) PCT Pub. No.: WO2019/187031
PCT Pub. Date: Oct. 3, 2019

(65) Prior Publication Data

US 2021/0002741 A1 Jan. 7, 2021

(51) Int. Cl.

| | |
|---|---|
| ***C21D 9/46*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/14*** | (2006.01) |
| ***C22C 38/20*** | (2006.01) |
| ***C22C 38/32*** | (2006.01) |

(52) U.S. Cl.
CPC ..... *C21D 9/46* (2013.01); *C21D 8/0205* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/20* (2013.01); *C22C 38/32* (2013.01); *C21D 2211/001* (2013.01); *C21D 2211/002* (2013.01); *C21D 2211/005* (2013.01); *C21D 2211/008* (2013.01)

(58) Field of Classification Search
CPC ..... C21D 9/46
See application file for complete search history.

(56) References Cited

U.S. PATENT DOCUMENTS

| | | | | |
|---|---|---|---|---|
| 2013/0266821 | A1 | 10/2013 | Kawasaki et al. | |
| 2018/0127856 | A1 * | 5/2018 | Takashima | C21D 6/005 |

FOREIGN PATENT DOCUMENTS

| | | | | |
|---|---|---|---|---|
| EP | 3178955 | A1 | 6/2017 | |
| EP | 3263728 | A1 | 1/2018 | |
| EP | 3460088 | A1 | 3/2019 | |
| EP | 3517643 | A1 | 7/2019 | |
| JP | 2002-88447 | A | 3/2002 | |
| JP | 2007-70661 | A | 3/2007 | |
| JP | 2009-13488 | A | 1/2009 | |
| JP | 2009-249669 | A | 10/2009 | |
| JP | 2010-65307 | A | 3/2010 | |
| JP | 2012-36497 | A | 2/2012 | |
| WO | WO-2016135794 | A1 * | 9/2016 | C21D 9/46 |
| WO | WO2018/030400 | A1 | 2/2018 | |
| WO | WO2018/055687 | A1 | 3/2018 | |

* cited by examiner

*Primary Examiner* — Jophy S. Koshy
(74) *Attorney, Agent, or Firm* — Birch, Stewart, Kolasch & Birch, LLP

(57) ABSTRACT

A steel sheet including, in mass %, C: 0.05% or more and 0.30% or less, Si: 0.05% or more and 6.00% or less, Mn: 1.50% or more and 10.00% or less, and the balance: Fe and impurities, a steel sheet structure is composed of, in area ratio, 15% or more and 80% or less of ferrite and 20% or more and 85% or less in total of a hard structure composed of any one of bainite, martensite, or retained austenite, or any combination thereof, and to a steel sheet thickness t, an area ratio of a maximum coupled ferrite region in a region from a t/2 position at the steel sheet thickness center to a position at a depth of 3t/8 from a surface is 80% or more in area ratio to a total ferrite area, and a two-dimensional isoperimetric constant of the maximum coupled ferrite region is 0.35 or less.

16 Claims, 2 Drawing Sheets

HIGH-STRENGTH STEEL SHEET WITH EXCELLENT DUCTILITY AND HOLE-EXPANDABILITY

TECHNICAL FIELD

The present invention relates to, for example, a steel sheet used for mechanical structural parts, and the like such as body structural parts of automobiles, and more specifically, a high-strength steel sheet with excellent ductility and hole-expandability.

BACKGROUND ART

A steel sheet used for raw materials such as structural members for transportation machinery and various industrial machinery, such as automobiles, is required to have excellent mechanical properties such as strength, workability, and toughness. In recent years, though application of a high-strength steel sheet has been expanding in terms of reducing weight of automobiles, both high-strength and excellent formability are required for the high-strength steel sheet because most automobile parts are manufactured by press-forming.

In particular, the high-strength steel sheet applied to members (sub-frames) and reinforcing members, which are framework members of automobiles, is required to have not only good ductility but also excellent hole-expandability.

However, there is generally a trade-off between tensile strength and stretch-flangeability, and as the tensile strength increases, elongation and hole-expandability significantly decrease. Accordingly, it is not easy to achieve all of the high tensile strength, and the excellent elongation and hole-expandability. For this reason, various measures have been taken to improve the elongation and hole-expandability of the high-strength steel sheet.

In response to the problem that it is difficult to achieve all of the high tensile strength, and the excellent elongation and hole-expandability, Patent Document 1 discloses that a 340 to 440 MPa class composite structure type high-tensile cold-rolled steel sheet with excellent workability can be manufactured by adjusting content ratios of Mn and B to $(Mn+1300\times B)\geq 2$, and making a steel structure a multiphase of a ferrite phase with a volume fraction of 95.0 to 99.5% and a low-temperature generating phase with a volume fraction of 0.5 to 5.0%.

Patent document 2 discloses a steel sheet with a tensile strength TS of 590 MPa or more and excellent ductility and hole-expandability manufactured by actively adding Si, significantly solid-solution strengthening ferrite, containing ferrite with a volume fraction of 94% or more, lowering a martensite volume fraction in a second phase, and reducing a size and aspect ratio of carbide existing at a grain boundary of ferrite.

However, in recent years, there has been a demand for a steel sheet with even higher strength, that is, a high-strength steel sheet with the tensile strength TS of 780 MPa or more.

In the conventional arts as represented by Patent Document 1 and Patent Document 2, problems that it is difficult to secure the above-mentioned high strength and the above-mentioned requirements cannot be satisfied arises because it is necessary to contain a ferrite phase for 94% or more in the steel sheet structure in terms of securing formability.

Accordingly, it is necessary to examine to achieve both ductility and hole-expandability of the steel sheet in addition to securing the TS strength of 780 MPa or more by containing a hard structure composed of bainite, martensite or retained austenite, or any combination of these, with a volume fraction of 20% or more.

However, in a structure of the steel sheet with a high second-phase fraction, ferrite parent phase grains are coupled in a plate state in a rolling direction to be a structure coupled in a band-shape (hereinafter, sometimes referred to as a "band-shaped structure"). In the band-shaped structure of ferrite, voids become denser and more easily coupled at the time of deformation, resulting in fracture in early stage, and especially, a remarkable decrease in the hole-expandability.

A factor for the formation of the band-shaped structure is that alloying elements such as Mn are segregated in a melting process during manufacturing and an element segregation region is stretched in the rolling direction during hot and cold rolling processes. To solve this essential problem, Patent Document 3 discloses that a steel sheet containing a martensite fraction of 20% or more is used to secure formability by once heating the steel sheet after cold rolling and pickling to a temperature range of 750° C. or more to disperse the thickened Mn in the band-shaped structure and to make a thickness of martensite distributed in the band shape thin and disperse finely as shown in Examples.

However, the method in Patent Document 3 requires the heating process for a long time, which results in low productivity and significantly increases the cost of the steel sheet. Further, since the formation of voids cannot be suppressed simply by thinning the thickness of the band-shaped structure, and the voids are unevenly distributed, the method of Patent Document 3 cannot secure the required formability.

In the end, the method of Patent Document 3 has problems of not being able to suppress the formation of the band-shaped structure itself and not being able to achieve excellent hole-expandability, not to mention the problem of productivity.

On the other hand, Patent Document 4 discloses a steel sheet whose stretch-flangeability is increased by holding at a heating temperature from an $Ac_3$ point to 1000° C. for 3600 seconds or less and cooling at 50° C./sec to make a steel structure a homogeneous martensite structure in first annealing, and further, reducing grain diameters of ferrite grains and isotropically dispersing a long axis direction of each ferrite grain in second annealing.

Patent Document 5 discloses a steel sheet whose elongation and stretch-flangeability are increased by holding at a temperature range of 1200° C. or more and 1300° C. or less for 0.5 h or more and 5 h or less to disperse Mn before a hot rolling process in the manufacturing method of Patent Document 4 to make a ratio C1/C2 between an upper limit value C1 and a lower limit of C2 of an Mn concentration in a sheet-thickness direction cross-section of the steel sheet to be 2.0 or less.

PRIOR ART DOCUMENT

Patent Document

[Patent Document 1] Japanese Laid-open Patent Publication No. 2009-013488

[Patent Document 2] Japanese Laid-open Patent Publication No. 2012-036497

[Patent Document 3] Japanese Laid-open Patent Publication No. 2002-088447

[Patent Document 4] Japanese Laid-open Patent Publication No. 2009-249669

[Patent Document 5] Japanese Laid-open Patent Publication No. 2010-065307

DISCLOSURE OF THE INVENTION

Problems to be Solved by the Invention

In general, multiple annealing or heat treatment at 1000° C. or more is essential to control the band-shaped structure. In the method of Patent Document 5, the band-shaped structure is controlled by holding at the high temperature. In this case, the band-shaped structure is slightly suppressed, but the cost of manufacturing increases and the band-shaped distribution of the Mn segregation portion itself does not resolve, resulting in a dense hard structure, which does not have an effect of suppressing void growth and coupling behavior.

In the steel sheet with the fraction of the hard structure exceeding 20%, voids are not formed at an interface between the hard structure and ferrite, but rather from the hard structure itself, such as martensite. Therefore, it is not possible to sufficiently secure the formability, especially the hole-expandability in the case of a large deformation speed, which is a practical problem, by simply reducing the ferrite grain diameter and relaxing stress concentration at an interface between martensite and ferrite, as in the method of Patent Document 4. Thus, there is no steel sheet with the tensile strength of 780 MPa or more and excellent ductility and impact properties.

The hole-expandability is measured by a method defined in JIS Z2256 or JFS T 1001. However, in recent years, with improvement of productivity owing to progress of manufacturing technology, test speed for quality survey of a product has been accelerated from 0.2 mm/sec that is used generally now, and it is required to test at the test speed close to 1 mm/sec of an upper limit of the definition.

However, since the higher test speed during the hole-expanding test causes an increase in a strain rate, measured values with the higher test speed are considered to be different from measured values with the conventional test speed. Therefore, there is no example of the hole-expanding test conducted at high test speed.

In consideration of the present situation concerning the conventional arts, the present inventors set forth a problem of improving ductility and hole-expandability in the case of fast processing speed without performing the multiple annealing or the heat treatment at high temperature for a long time, and aim to provide a high-strength steel sheet solving the problems.

Means for Solving the Problems

The present inventors had eagerly studied a method to solve the above problems. As a result, the following new findings were obtained.

(x) Amounts of C, Si, and Mn are limited to required ranges. (x-1) In hot rolling, rough rolling, which is usually carried out continuously in one direction, is carried out only by reverse rolling where one roll stage is rolled back and forth several times, and a shape of the Mn segregation portion in a rough hot-rolled steel sheet, which is a formation factor of the band-shaped structure, is made to be not a plate state but a complex shape. (x-2) Ferrite in the structure after annealing is made into a highly complex mesh-like coupled structure, and a hard structure composed of any one of bainite, martensite, or retained austenite, or any combination thereof is made exist in ferrite. When the hard structure acts as a support and ferrite acts as stress relaxation complementary, the growth and coupling behavior of voids are suppressed and the hole-expandability is improved. (x-3) As a result, "the steel sheet with the tensile strength of 780 MPa or more and excellent ductility and hole-expandability" can be obtained, which is difficult to achieve with conventional arts. Here, martensite includes fresh martensite and tempered martensite.

(y) In the hole-expanding test, higher test speed causes the increase in the strain rate, and the measured values with the higher test speed are different from those with the conventional test speed. In evaluation of the hole-expandability of the high-strength steel sheet, it is important to measure at high test speed.

The above new findings will be described later.

The present invention is based on the above-mentioned new findings, and the gist of the invention is as follows (1) A high-strength steel sheet with excellent ductility and hole-expandability, including: a steel sheet with a chemical composition, in mass %, C: 0.05% or more and 0.30% or less, Si: 0.05% or more and 6.00% or less, Mn: 1.50% or more and 10.00% or less, P: 0.000% or more and 0.100% or less, S: 0.000% or more and 0.010% or less, sol. Al: 0.010% or more and 1.000% or less, N: 0.000% or more and 0.010% or less, Ti: 0.000% or more and 0.200% or less, Nb: 0.000% or more and 0.200% or less, V: 0.000% or more and 0.200% or less, Cr: 0.000% or more and 1.000% or less, Mo: 0.000% or more and 1.000% or less, Cu: 0.000% or more and 1.000% or less, Ni: 0.000% or more and 1.000% or less, Ca: 0.0000% or more and 0.0100% or less, Mg: 0.0000% or more and 0.0100% or less, REM: 0.0000% or more and 0.0100% or less, Zr: 0.0000% or more and 0.0100% or less, W: 0.0000% or more and 0.0050% or less, B: 0.0000% or more and 0.0030% or less, and the balance: Fe and inevitable impurities, wherein a structure of the steel sheet is composed of, in area ratio, 15% or more and 80% or less of ferrite and 20% or more and 85% or less in total of a hard structure composed of any one of bainite, martensite, or retained austenite, or any combination thereof, and an area ratio of a maximum coupled ferrite region in a region from a position at a depth of 3t/8 from a surface to a position at a depth of t/2 (t: sheet thickness of steel sheet) is 80% or more in area ratio to a total ferrite area, and a two-dimensional isoperimetric constant of the maximum coupled ferrite region is 0.35 or less.

(2) The high-strength steel sheet with excellent ductility and hole-expandability according to (1), which contains, in mass %, one type or two or more types of Ti: 0.003% or more and 0.200% or less, Nb: 0.003% or more and 0.200% or less, and V: 0.003% or more and 0.200% or less.

(3) The high-strength steel sheet with excellent ductility and hole-expandability according to (1) or (2), which contains, in mass %, one type or two or more types of Cr: 0.005% or more and 1.000% or less, Mo: 0.005% or more and 1.000% or less, Cu: 0.005% or more and 1.000% or less, and Ni: 0.005% or more and 1.000% or less.

(4) The high-strength steel sheet with excellent ductility and hole-expandability according to any one of (1) to (3), which contains, in mass %, one type or two or more types of Ca: 0.0003% or more and 0.0100% or less, Mg: 0.0003% or more and 0.0100% or less, REM: 0.0003% or more and 0.0100% or less, Zr: 0.0003% or more and 0.0100% or less, and W: 0.0003% or more and 0.0050% or less.

(5) The high-strength steel sheet with excellent ductility and hole-expandability according to any one of (1) to (4), which contains, in mass %, B: 0.0001% or more and 0.0030% or less.

Effect of the Invention

According to the present invention, the high-strength steel sheet with the tensile strength of 780 MPa or more and excellent ductility and hole-expandability can be provided. The high-strength steel sheet according to the present invention is suitable for a steel sheet that is to be press-formed, such as automobile bodies, and in particular, for a steel sheet that requires ductility and stretch flange forming, which have been difficult to apply in the past.

EMBODIMENTS FOR CARRYING OUT THE INVENTION

Figure 1:
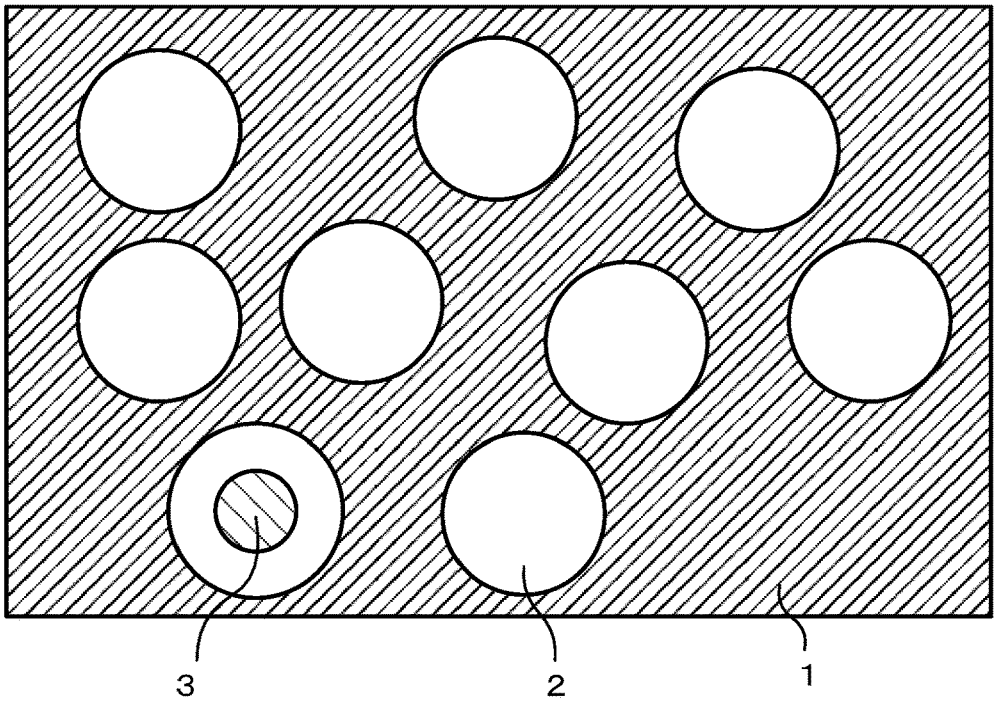
FIG. 1 is a diagram schematically illustrating a maximum coupled ferrite region in a steel-sheet structure.

A high-strength steel sheet with excellent ductility and hole-expandability of the present invention (hereinafter, it is sometimes referred to as the "steel sheet of the present invention") includes: a chemical composition, in mass %, made up of C: 0.05% or more and 0.30% or less, Si: 0.05% or more and 6.00% or less, Mn: 1.50% or more and 10.00% or less, P: 0.000% or more and 0.100% or less, S: 0.000% or more and 0.010% or less, sol. Al: 0.010% or more and 1.000% or less, N: 0.000% or more and 0.010% or less, Ti: 0.000% or more and 0.200% or less, Nb: 0.000% or more and 0.200% or less, V: 0.000% or more and 0.200% or less, Cr: 0.000% or more and 1.000% or less, Mo: 0.000% or more and 1.000% or less, Cu: 0.000% or more and 1.000% or less, Ni: 0.000% or more and 1.000% or less, Ca: 0.0000% or more and 0.0100% or less, Mg: 0.0000% or more and 0.0100% or less, REM: 0.0000% or more and 0.0100% or less, Zr: 0.0000% or more and 0.0100% or less, W: 0.0000% or more and 0.0050% or less, B: 0.0000% or more and 0.0030% or less, and the balance: Fe and inevitable impurities, wherein a structure of the steel sheet is made up of, in area ratio, 15% or more and 80% or less of ferrite and 20% or more and 85% or less in total of a hard structure composed of any one of bainite, martensite, or retained austenite, or any combination thereof, and an area ratio of a maximum coupled ferrite region in a region from a position at a depth of 3t/8 from a surface to a position at a depth of t/2 (t: sheet thickness of steel sheet) is 80% or more in area ratio to a total ferrite area, and a two-dimensional isoperimetric constant of the maximum coupled ferrite region is 0.35 or less.

Hereinafter, the steel sheet of the present invention is explained.

First, reasons for limitation of the chemical composition of the steel sheet of the present invention are explained. In the following, "%" for the chemical composition means "mass %".

Chemical Composition

C: 0.05% or more and 0.30% or LESS

C is an important element that improves hardenability to secure strength. A C content is set to 0.05% or more because it becomes difficult to secure the tensile strength of 780 MPa or more when the C content is less than 0.05%. The C content is preferably 0.10% or more.

On the other hand, when the C content exceeds 0.30%, martensite becomes hard and weldability significantly decreases, so the C content is set to 0.30% or less, and preferably 0.20% or less.

Si: 0.05% or MORE and 6.00% or less

Si is an element that can increase tensile strength without inhibiting hole-expandability by solid-solution strengthening. When a Si content is less than 0.05%, an addition effect cannot be obtained sufficiently, so the Si content is set to 0.05% or more. To stably promote formation of a ferrite phase, the Si content is preferably 0.50% or more, and more preferably 1.00% or more.

On the other hand, when the Si content exceeds 6.00%, the addition effect is saturated, economic efficiency declines, and surface properties deteriorate, so the Si content is set to 6.00% or less. The Si content is preferably 5.00% or less, and more preferably 3.00% or less.

Mn: 1.50% or more and 10.00% or less

Mn is an element that improves hardenability and contributes to secure strength. When an Mn content is less than 1.50%, the tensile strength of 780 MPa or more is difficult to be secured, so the Mn content is set to 1.50% or more. The Mn content is preferably 2.00% or more in terms of securing productivity of hot rolling and cold rolling.

On the other hand, when the Mn content exceeds 10.00%, MnS precipitates and low-temperature toughness decreases, so the Mn content is set to 10.00% or less, and preferably 5.00% or less.

P: 0.000% or more and 0.100% or less

P is usually an impurity element, but it is also an element that contributes to improvement of tensile strength. When a P content exceeds 0.100%, weldability significantly decreases, so the P content is set to 0.100% or less. The P content is preferably 0.050% or less, and more preferably 0.025% or less. The P content is preferably 0.010% or more to improve the tensile strength.

A lower limit includes 0.000%, but when the P content is reduced to less than 0.0001% as the impurity element, steelmaking cost will rise significantly, so a substantial lower limit for a practical steel sheet is 0.0001%.

S: 0.000% or more and 0.010% or less

S is an impurity element, and the less the element, the more desirable it is in terms of weldability. When an S content exceeds 0.010%, the weldability significantly decreases and low-temperature toughness decreases due to precipitation of MnS, so the S content is set to 0.010% or less. The S content is preferably 0.003% or less, and more preferably 0.001% or less.

A lower limit includes 0.000%, but when the S content is reduced to less than 0.0001% as the impurity element, steelmaking cost will rise significantly, so the substantial lower limit for a practical steel sheet is 0.0001%.

sol. Al: 0.010% or more and 1.000% or less

Al is an element that deoxidizes steel to make the steel sheet sound. When a sol. Al content is less than 0.010%, an addition effect cannot be obtained sufficiently, so the sol. Al content is set to 0.010% or more. The sol. Al content is preferably 0.015% or more, and more preferably 0.030% or more.

On the other hand, when the sol. Al content exceeds 1.000%, weldability significantly decreases, oxide-based inclusions increase, and surface properties decrease, so the sol. Al content is set to 1.000% or less. The sol. Al content is preferably 0.700% or less, and more preferably 0.400% or less. Here, sol. Al means acid-soluble Al which is not an oxide such as $Al_2O_3$, and soluble in acid.

N: 0.000% or more and 0.010% or less

N is an impurity element, and the less the element, the more desirable it is in terms of weldability. When an N content exceeds 0.010%, weldability significantly decreases, so the N content is set to 0.010% or less. The N content is preferably 0.006% or less, and more preferably 0.003% or less.

A lower limit includes 0.000%, but when the N content is reduced to less than 0.0001% as the impurity element, steelmaking cost will rise significantly, so a substantial lower limit for a practical steel sheet is 0.0001%.

The chemical composition of the steel sheet of the present invention may contain one group or two or more groups of (a) one type or two or more types of Ti: 0.000% or more and 0.200% or less, Nb: 0.000% or more and 0.200% or less, and V: 0.000% or more and 0.200% or less, (b) one type or two or more types of Cr: 0.000% or more and 1.000% or less, Mo: 0.000% or more and 1.000% or less, Cu: 0.000% or more and 1.000% or less, and Ni: 0.000% or more and 1.000% or less, (c) one type or two or more types of Ca: 0.0000% or more and 0.0100% or less, Mg: 0.0000% or more and 0.0100% or less, REM: 0.0000% or more and 0.0100% or less, Zr: 0.0000% or more and 0.0100% or less, and W: 0.0000% or more and 0.0050% or less, and (d) B: 0.0000% or more and 0.0030% or less, in addition to the above elements in terms of improving properties of the steel sheet of the present invention.

(a) Group Elements

Ti: 0.000% or more and 0.200% or less

Nb: 0.000% or more and 0.200% or less

V: 0.000% or more and 0.200% or less

All of these elements contribute to increase in strength. A content of each element is preferably 0.200% or less because the strength increases too much, making hot rolling and cold rolling difficult when the content exceeds 0.200%. Though a lower limit includes 0.000%, the content of each element is preferably 0.003% or more to certainly obtain an addition effect.

(b) Group Elements

Cr: 0.000% or more and 1.000% or less

Mo: 0.000% or more and 1.000% or less

Cu: 0.000% or more and 1.000% or less

Ni: 0.000% or more and 1.000% or less

All of these elements contribute to increase in strength. A content of each element is preferably 1.000% or less because an addition effect is saturated and economic efficiency decreases when the content exceeds 1.000%. Though a lower limit includes 0.000%, the content of each element is preferably 0.005% or more to certainly obtain the addition effect.

(c) Group Elements

Ca: 0.0000% or more and 0.0100% or less

Mg: 0.0000% or more and 0.0100% or less

REM: 0.0000% or more and 0.0100% or less

Zr: 0.0000% or more and 0.0100% or less

W: 0.0000% or more and 0.0100% or less

All of these elements contribute to control of inclusions, in particular, improvement of toughness by miniaturizing and dispersing the inclusions. A content of each element is preferably 0.0100% or less because there is a concern that surface properties may significantly decrease when the content exceeds 0.0100%. Though a lower limit includes 0.0000%, the content of each element is preferably 0.0003% or more to certainly obtain an addition effect.

REM means a total of 17 elements of Sc, Y, and lanthanoids, and is at least one type among these elements. An amount of REM means the total amount of at least one type of these elements. Lanthanoids are industrially added in a form of misch metals.

(d) Group Element

B: 0.0000% or more and 0.0030% or less

B is an element that improves hardenability and is useful for increasing the strength of a bake-hardening steel sheet. Accordingly, a B content is preferably 0.0001% or more. The B content is set to 0.0030% or less because adding more than 0.0030% would saturate the above effects and would be economically ineffective. The B content is preferably 0.0025% or less.

The balance of the chemical composition of the steel sheet of the present invention is made up of Fe and inevitable impurities, except for the above elements. The inevitable impurities are elements that are inevitably mixed in from steel raw materials and/or in a steelmaking process and are allowed to exist to the extent that they do not interfere with the properties of the steel sheet of the present invention.

Next, a structure steel sheet of the steel sheet of the present invention is explained.

Steel Sheet Structure

The steel sheet of the present invention is characterized in that: a structure of the steel sheet is made up of, in area ratio, 15% or more and 80% or less of ferrite and 20% or more and 85% or less in total of a hard structure composed of any one of bainite, martensite, or retained austenite, or any combination thereof; an area ratio of a maximum coupled ferrite region from a position at a depth of 3t/8 from a surface to a position at a depth of t/2 (t: sheet thickness of steel sheet) is 80% or more in area ratio to a total ferrite area; and a two-dimensional isoperimetric constant of the maximum coupled ferrite region is 0.35 or less.

Hereinafter, structural requirements are explained, where "%" for a structural fraction means an "area ratio".

Ferrite: 15% or more and 80% or less

At a position of ¼ (or ¾) of a width of the steel sheet, a sheet thickness cross-section parallel or perpendicular to a rolling direction is corroded by LePera etching, and a structural image obtained by photographing the corroded surface using an optical microscope at a magnification of 500 times is analyzed, and an area ratio of ferrite and an area ratio of the hard structure composed of any one of bainite, martensite, or retained austenite, or any combination thereof (hereinafter, sometimes simply referred to as the "hard structure") are calculated to be defined.

The area ratio of ferrite and the area ratio of the hard structure can be measured as follows. First, a sample is taken such that a cross-section perpendicular to a width direction at the position of ¼ of the width of the steel sheet is exposed, and this cross-section is corroded by a LePera etchant. Next, an optical micrograph of the region from the position at the depth of 3t/8 from the surface to the position at the depth of t/2 (t: sheet thickness of steel sheet) is photographed. At this time, the magnification is set to, for example, 500 times. An observed surface can be approximately distinguished into black and white portions by the corrosion using the LePera etchant. The black portions may contain ferrite, bainite, carbide, and perlite. Within the black portion, a portion that contains a lamellar structure within a grain corresponds to perlite. Within the black portion, a portion that does not contain any lamellar structure or substructure within the grain corresponds to ferrite. Within the black portion, a portion that is spherical with a diameter of about 1 μm to 5 μm with a particularly low brightness corresponds to carbide. Within the black portion, a portion that contains the substructure within the grain corresponds to bainite The substructure means lath, block, and packet structures in bainite. Accordingly, the area ratio of ferrite can be obtained by measuring an area ratio of the black portions containing neither the lamellar structure nor the substructure within the grain, and an area ratio of bainite can be obtained by measuring an area ratio of the black portions with the substructure within the grain. An area ratio of the white portions is a total area ratio of martensite and retained austenite. Accordingly, the area ratio of the hard structure can be obtained from the area ratio of bainite and the total area ratio of martensite and retained austenite. The maximum coupled ferrite region and the two-dimensional isoperimetric constant thereof can be measured from the optical micrograph.

The area ratio of ferrite is set to 15% or more because total elongation of 10% or more is difficult to be secured when the area ratio of ferrite is less than 15%. The area ratio is preferably 20% or more. On the other hand, when the area ratio of ferrite exceeds 80%, the tensile strength decreases, and the tensile strength of 780 MPa or more cannot be secured, so the area ratio of ferrite is set to 80% or less, and preferably 70% or less.

Hard structure: 20% or more and 85% or less in total

When the total area ratio of the hard structure (composed of any one of bainite, martensite, or retained austenite, or any combination thereof) is less than 20%, the tensile strength decreases and the tensile strength of 780 MPa or more cannot be secured, so the total area ratio of the hard structure is set to 20% or more, and preferably 30% or more.

On the other hand, ductility decreases when the total area ratio of the hard structure exceeds 85%, so the total area ratio of the hard structure is set to 85% or less, and preferably 80% or less.

Area ratio of maximum coupled ferrite region in region from position at depth of 3t/8 from surface to position at depth of t/2 (t: sheet thickness of steel sheet): 80% or more in area ratio to total ferrite area Two-dimensional isoperimetric constant of maximum coupled ferrite region: 0.35 or less First, the maximum coupled ferrite region and the two-dimensional isoperimetric constant are explained. FIG. 1 schematically illustrates a maximum coupled ferrite region 1 in a structure of the steel sheet. The maximum coupled ferrite region 1 is a structure where ferrite grains are continuously coupled in mesh. A fine oblique line portion in FIG. 1 is the maximum coupled ferrite region 1, each white portion is a hard structure region 2, and a coarse oblique line portion is a ferrite region 3 (non-maximum coupled ferrite region 3), which is not the maximum coupled ferrite region 1. For ease of distinction, inclining manners of the oblique lines are shown opposite to each other between the maximum coupled ferrite region 1 and the non-maximum coupled ferrite region 3. A plurality of hard structure regions 2 (white portions) exist in the maximum coupled ferrite region 1 separated from each other. The non-maximum coupled ferrite regions 3 are separated from the maximum coupled ferrite region 1, and each non-maximum coupled ferrite region 3 is surrounded by the hard structure region 2 (white portion).

The maximum coupled ferrite region is determined by the following method.

The structural image at 500 times magnification in the region from the position at the depth of 3t/8 from the surface to the position at the depth of t/2 (t: sheet thickness of steel sheet) is binarized using the above method, and one pixel indicating the ferrite region in the binarized image is selected. When a pixel adjacent to the selected pixel (which indicates the ferrite region) in any of four directions of top, bottom, left and right indicates the ferrite region, these two pixels are judged to be the same coupled ferrite region. In the same way, a range of a single coupled ferrite region is determined by sequentially judging whether each of the adjacent pixels in the four directions of top, bottom, left and right is the coupled ferrite region. When the adjacent pixel is not a pixel indicating the ferrite region (that is, when the adjacent pixel is a pixel indicating the hard structure region), the portion is an edge portion of the coupled ferrite region. A region with the maximum number of pixels among the coupled ferrite regions determined as stated above is identified as the maximum coupled ferrite region.

An area ratio $R_F$ of the maximum coupled ferrite region to the total ferrite region is obtained by finding an area $S_M$ of the maximum coupled ferrite region and calculating from a ratio to an area $S_F$ of the total ferrite region: $R_F=S_M/S_F$.

The area ratio $R_F$ (%) of the maximum coupled ferrite region is calculated by the following expression.

$$R_F=\{\text{the area } S_M \text{ of the maximum coupled ferrite region/the area } S_F \text{ of the total ferrite region}\}\times 100$$

$$\text{The area } S_F \text{ of the total ferrite region}=\text{the area } S_M \text{ of the maximum coupled ferrite region}+\text{a total area } S_M' \text{ of the non-maximum coupled ferrite regions}$$

A two-dimensional isoperimetric constant K is calculated by the following expression. A peripheral length $L_M$ of the maximum coupled ferrite region can be measured in the above optical micrograph. Note that, when any of four sides of an image data outer frame is part of the peripheral length of the maximum coupled ferrite when calculating the peripheral length, the length of a corresponding outer frame is treated as part of the peripheral length of the maximum coupled ferrite.

$$\pi\cdot(L_M/2\pi)^2\cdot K=S_M$$

$$K=4\pi S_M/L_M^2$$

$L_M$: peripheral length of maximum coupled ferrite region

When large localized deformation is applied to the steel sheet as in the hole-expanding test, the steel sheet will fracture through necking and voids formed and coupled in the structure of the steel sheet. In a tensile deformation where the steel sheet is constricted, stress concentrates near the center of the steel sheet thickness, and the voids are usually formed around a t/2 (t: sheet thickness) position from a steel sheet surface (hereinafter referred to as the "t/2 position"). By the time the steel sheet fractures, void coupling occurs, but when the void becomes coarser than a certain size, the fracture occurs with the coarsened void as a starting point.

The region contributing to the coupling of voids formed at the t/2 position is estimated to be the structure at the region from the t/2 position to the position of 3t/8 (t: sheet thickness) from the steel sheet surface (hereinafter referred to as the "3t/8 position"). The region that defines the area ratio of the maximum coupled ferrite area is therefore defined as the region from the position at the depth of 3t/8 from the surface to the position at the depth of t/2 (t: sheet thickness of steel sheet).

When the area ratio of the maximum coupled ferrite region is less than 80% in area ratio to the total ferrite area, a coupling and growth suppression effect of voids cannot be obtained by specifying the two-dimensional isoperimetric constant of the maximum coupled ferrite region to be 0.35 or less. The area ratio of the maximum coupled ferrite region is therefore set to 80% or more in area ratio to the total ferrite area, and preferably 90% or more.

When the two-dimensional isoperimetric constant of the maximum coupled ferrite region exceeds 0.35, martensite becomes a void formation site, and when voids are formed, the stress concentrates on the ferrite around the voids, and the coupling and growth of the voids progress. The formation, growth, and coupling of the voids in the structure are a chain reaction that leads to breakage of the steel sheet. As a result, required hole-expandability cannot be secured in the structure of the steel sheet, so the two-dimensional isoperimetric constant of the maximum coupled ferrite region is set to 0.35 or less, and preferably 0.25 or less. In a structure with the two-dimensional isoperimetric constant larger than 0.35, deformation tends to concentrate in a specific region of the structure, and once a void is formed, the deformation further concentrates around the void and the growth of the void is significantly accelerated. Thus, such a structure is prone to breakage. On the other hand, in a structure with the two-dimensional isoperimetric constant of 0.35 or less, deformation is less likely to concentrate and void formation is less likely to occur because of a complex shape of an interface between ferrite and the hard structure. Even once a void is formed, the concentration of deformation is easily dispersed because the void is surrounded by supports of the hard structure, which inhibits the growth and coupling of the void. The breakage is therefore unlikely to occur in the structure with the two-dimensional isoperimetric constant of 0.35 or less.

Next, mechanical properties of the steel sheet of the present invention are explained.

Mechanical Properties

Tensile Strength (TS)

The tensile strength (TS) of the steel sheet of the present invention is preferably 780 MPa or more, which is sufficient to contribute to weight reduction of automobiles. The tensile strength is more preferably 800 MPa or more, and further preferably 900 MPa or more.

Hole-Expandability

The hole-expandability is preferably 30% or more in a hole expansion ratio (HER) measured with the test speed set as 1 mm/sec in the hole expanding test defined in JIS Z2256 or JFS T 1001.

Ductility

For ductility, a JIS No. 5 tensile test piece, whose tensile direction is perpendicular to the rolling direction, is taken from the steel sheet, and a fracture elongation El measured by the tensile test defined in JIS Z 2241 is preferably 10% or more.

Next, a preferred manufacturing method of the steel sheet of the present invention is explained.

To manufacture the steel sheet of the present invention having the tensile strength of 780 MPa or more and excellent ductility and hole-expandability, it is necessary to control the structure of the steel sheet to form "a structure of the steel sheet that is made up of, in area ratio, 15% or more and 80% or less of ferrite, and 20% or more and 85% or less in total of a hard structure composed of bainite, martensite, or retained austenite, or any combination thereof, where the area ratio of the maximum coupled ferrite region in the region from the position at the depth of 3t/8 from the surface to the position at the depth of t/2 (t: sheet thickness of steel sheet) is 80% or more in area ratio to the total ferrite area, and the two-dimensional isoperimetric constant of the maximum coupled ferrite region is 0.35 or less".

Specifically, it is preferable to perform the following (A) to (C) to form the above-stated structure of the steel sheet.

(A) A steel slab having the chemical composition of the steel sheet of the present invention is subjected to reverse rolling where rolling at a reduction ratio of 30% or less per one pass is repeated even number of times at a temperature range of 1050° C. or more and 1250° C. or less, and the reverse rolling is reciprocated once or more times so that the reduction ratio difference between the two passes in one reciprocation is within 10% to obtain a rough-rolled steel sheet.

(B) The rough-rolled steel sheet is subjected to finish rolling at a temperature of 850° C. or more and 1150° C. or less to obtain a hot-rolled steel sheet and is coiled up at a temperature range of 700° C. or less. After that, the hot-rolled steel sheet is subjected to cold rolling after pickling to obtain a cold-rolled steel sheet.

(C) The cold-rolled steel sheet is subjected to continuous annealing at a temperature range of 740° C. or more and 950° C. or less.

Hereinafter, process conditions are explained. First, a molten steel having the chemical composition of the steel sheet of the present invention is cast to produce a slab, which is subjected to the rough rolling. A normal casting method can be used, and a continuous casting method or ingot-making method can be employed, but the continuous casting method is preferable in terms of productivity.

(A) Rough Rolling Process

Rough rolling temperature range: 1050° C. or more and 1250° C. or less

Reduction ratio per one pass: 30% or less

The number of times of reverse rolling: one reciprocation or more

Reduction ratio difference between two passes in one reciprocation: 10% or less

The slab is preferably heated to a solution temperature range of 1050° C. or more and 1250° C. or less before the rough rolling. A heating and holding time is not particularly defined, but the slab is preferably held at the heating temperature for 30 minutes or more to improve the hole-expandability. The heating and holding time is preferably 10 hours or less, and more preferably five hours or less to suppress excessive scale loss. When the temperature of the slab after casting is 1050° C. or more and 1250° C. or less, the slab can be subjected to rough rolling as it is without being heated and held at the temperature range, to perform hot direct rolling or direct rolling.

Next, an Mn segregation portion of the slab formed during solidification can be made into a complex shape without becoming a plate-like segregation portion extending in one direction by subjecting the slab to the rough rolling by reverse rolling. A mechanism of forming the complex shape of the Mn segregation portion is explained based on FIGS. 2 to 4.

Figure 2:
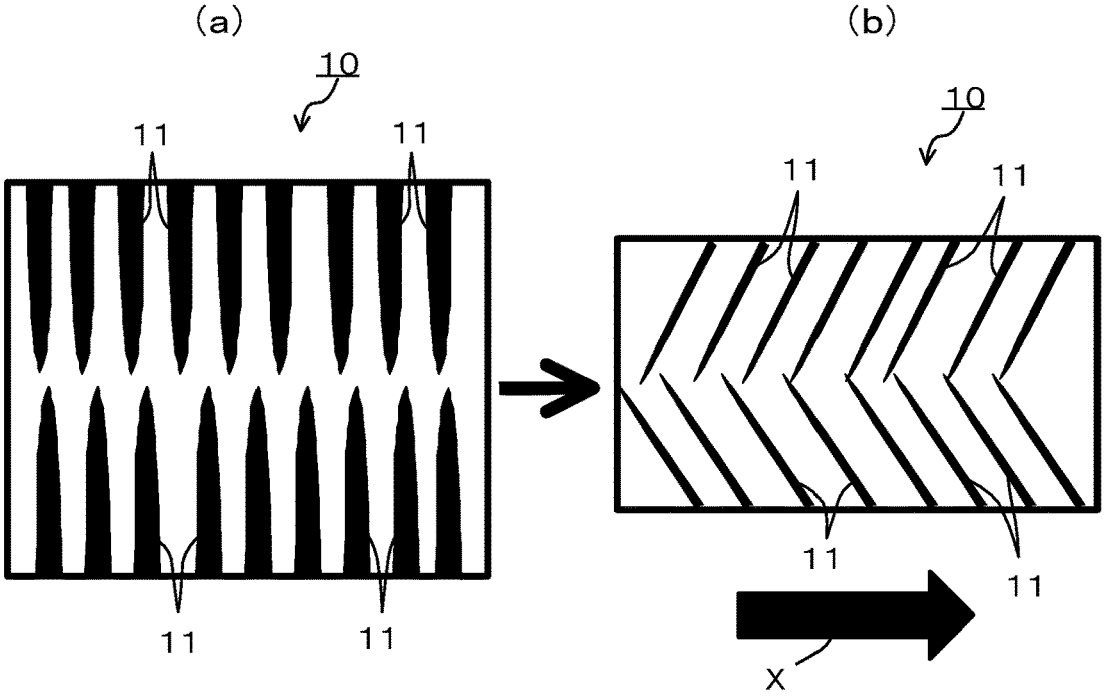
FIG. 2(*a*) and FIG. 2(*b*) are explanatory diagrams of rough rolling.

As illustrated in FIG. 2(*a*), in a slab 10 before rough rolling begins, portions 11 where alloying elements such as Mn concentrate (hereinafter referred to as an "Mn segregation portion 11") have grown almost vertically from a surface of the slab 10 toward the interior.

On the other hand, in rough rolling, the surface of the slab 10 is stretched in a rolling progress direction every one rolling pass, as illustrated in FIG. 2(*b*). Here, the rolling progress direction is a direction where the slab 10 progresses with respect to a rolling roll and indicated by a direction of an arrow X in FIG. 2. By stretching the surface of the slab 10 in the rolling progress direction in this way, the Mn segregation portions 11, which are growing from the surface of the slab 10 toward the interior, are inclined every one rolling pass.

Figure 3:
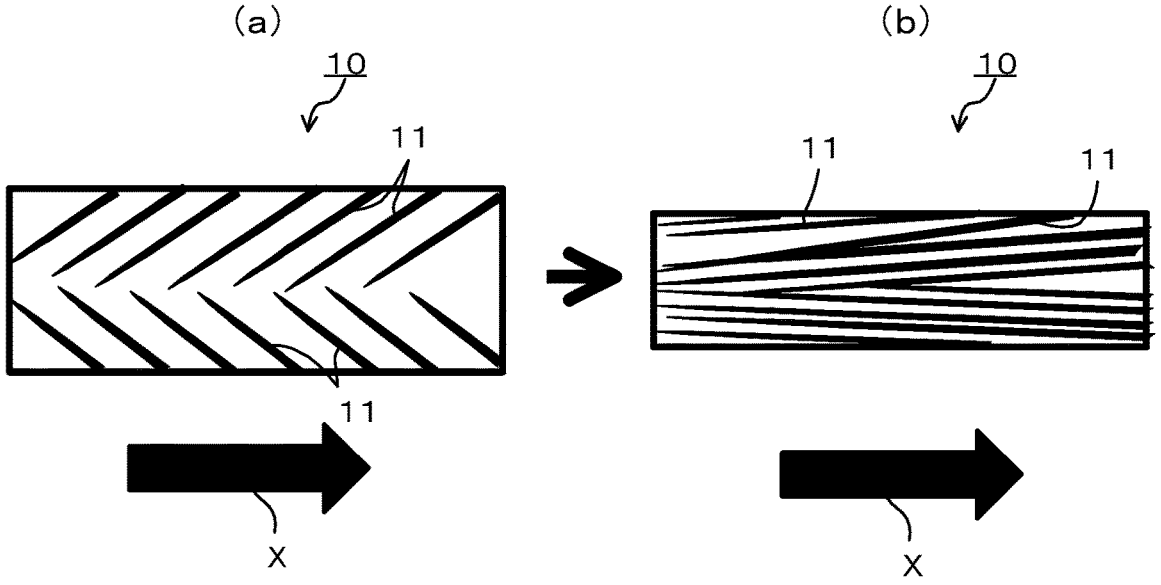
FIG. 3(*a*) and FIG. 3(*b*) are explanatory diagrams of unidirectional rolling.

Here, in the case of what is called unidirectional rolling, where a progress direction X of the slab 10 in each pass of the rough rolling is always the same direction, the Mn segregation portions 11 gradually become more inclined in the same direction in each pass, while keeping almost a straight state, as illustrated in FIG. 3(*a*). At the end of the rough rolling, the Mn segregation portions 11 are almost parallel to the surface of the slab 10 while keeping the straight state, and a flat band-shaped structure is formed. As a result, the voids are likely to couple during deformation to decrease the hole-expandability.

Figure 4:
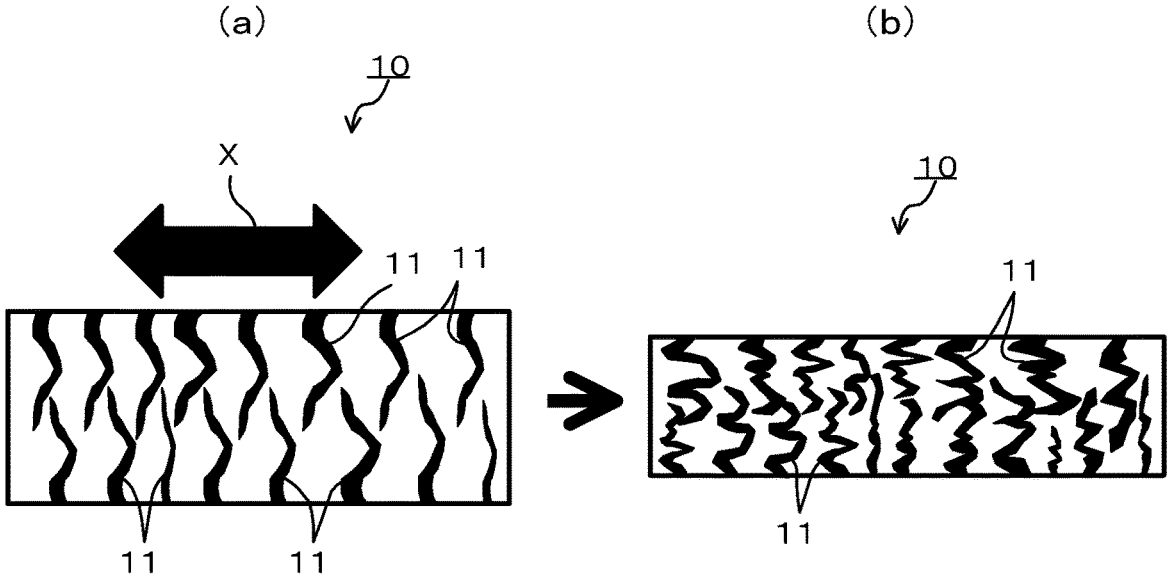
FIG. 4(*a*) and FIG. 4(*b*) are explanatory diagrams of reverse rolling.

On the other hand, in the case of the reverse rolling, where the progress direction of the slab 10 in each pass of the rough rolling alternates in opposite directions, the Mn segregation portion 11 that was inclined in a previous pass is inclined in an opposite direction in the next pass, resulting in a bent shape of the Mn segregation portion 11 as illustrated in FIG. 4(*a*). In the reverse rolling, each pass that alternates in the opposite direction is repeated, and the Mn segregation portion 11 becomes a complex bent shape as illustrated in FIG. 4(*a*). In this specification, the shape of the Mn segregation portion 11, which has become the complex bent shape as a result of reverse rolling, is sometimes referred to as the "complex shape". By making the Mn segregation portion 11 complex in shape in this way by the reverse rolling, formation of the band-shaped structure can be suppressed in a post-process and a complex mesh-like structure of ferrite can be formed. Since Mn is an element that stabilizes austenite, austenite tends to form in the Mn segregation portion 11, while ferrite tends to form in the region where Mn is not segregated. When the Mn segregation portion 11 is made complex in shape by the reverse rolling, ferrite is formed while avoiding the Mn segregation portion 11 in a process of forming ferrite in austenite during the subsequent annealing process, and mesh-like ferrite is formed, and as a result, the area ratio of the maximum coupled ferrite region to the total ferrite area in area ratio is considered to be 80% or more. By making the Mn segregation portion 11 complex in shape, the interface between ferrite and the hard structure also becomes complex in shape, and it is considered that the two-dimensional isoperimetric constant of the maximum coupled ferrite region becomes 0.35 or less.

To achieve the desired complex shape of the Mn segregation portion 11 (the complex shape which enables that the area ratio of the maximum coupled ferrite region is 80% or more in area ratio to the total ferrite area, and the two-dimensional isoperimetric constant of the maximum coupled ferrite region is 0.35 or less, in the annealing process), the number of times of the reverse rolling is preferably one reciprocation or more, and more preferably two reciprocations or more. When ten reciprocations or more are made, it will be difficult to secure a sufficient finish rolling temperature, so the number of times of the reverse rolling is ten reciprocations or less, and preferably eight reciprocations or less. Each pass whose progress direction is opposite to each other is preferably made the same number of times. For example, it is preferable that a rightward pass (rolling) and a leftward pass (rolling) indicated by an arrow X in FIG. 4(*a*) are performed the same number of times each. However, in a typical rough rolling line, an entry side and an exit side of the rough rolling are located on opposite sides of rolls. The number of times of passes (rolling) in the direction from the entry side to the exit side of the rough rolling is therefore increased once. As a result, the Mn segregation portion 11 becomes flat in the last pass (rolling), and the band-shaped structure is easily formed. In the case of rough rolling on such a hot rolling line, a reduction ratio when the rough-rolled sheet is finally passed from the entry side to the exit side (final pass reduction ratio after reverse rolling) is preferably set to 5% or less, and it is more preferable to open between the rolls to omit the rolling (reduction ratio of 0%).

When the rough rolling temperature range is less than 1050° C., it becomes difficult to complete rolling at 850° C. or more in finish rolling and the ferrite shape becomes inferior, so the rough rolling temperature range is preferably 1050° C. or more, and more preferably 1100° C. or more. When the rough rolling temperature range exceeds 1250° C., scale loss increases, and slab cracking may occur, so the rough rolling temperature range is preferably 1250° C. or less, and more preferably 1200° C. or less.

When a reduction amount per one pass in the rough rolling exceeds 30%, shearing stress during rolling increases and the Mn segregation portion becomes banded and cannot be made into the complex shape, so the reduction amount per one pass in the rough rolling is set to 30% or less. The smaller the reduction amount is, the smaller shear strain during rolling becomes, and the formation of the band structure can be suppressed. Therefore, though a lower limit of the reduction ratio is not particularly specified, it is preferably 10% or more in terms of productivity.

In reverse rolling, when there is the difference in the reduction amount between two passes included in one reciprocation, the Mn segregation portion will collapse in either direction, making it impossible to control the Mn segregation portion into the complex shape. The difference in the reduction amount between the two passes included in one reciprocation of the reverse rolling is therefore set to be within 10%, preferably within 5%, and further preferably within 3%, at the rough rolling time.

(B) Finish Rolling and Cold Rolling (B-1) Finish Rolling

Finish rolling temperature: 850° C. or more and 1150° C. or less

Coiling temperature: 700° C. or less

When the finish rolling temperature is less than 850° C., recrystallization does not occur sufficiently, resulting in a structure that is stretched in the rolling direction, and a band structure is formed in a post-process due to the stretched structure, so the finish rolling temperature is preferably 850° C. or more, and more preferably 900° C. or more. On the other hand, when the finish rolling temperature exceeds 1150° C., scale loss increases and yields decrease, so the finish rolling temperature is preferably 1150° C. or less, and more preferably 1100° C. or less.

When the coiling temperature exceeds 700° C., surface properties decrease due to internal oxidation, so the coiling temperature is preferably 700° C. or less. When the structure of the steel sheet has a homogeneous structure of martensite or bainite, it is easier to form a homogeneous structure by annealing, so the coiling temperature is more preferably 450° C. or less, and further preferably 50° C. or less.

(B-2) Cold Rolling

The hot-rolled steel sheet is subjected to cold rolling after pickling to obtain a cold-rolled steel sheet. To homogenize and miniaturize the steel sheet structure, the reduction ratio is preferably 50% or more. Note that the pickling may be a normal one.

(C) Annealing Process

Annealing temperature range: $Ac_1$° C. or more and ($Ac_3$+100)° C. or less

The cold-rolled steel sheet is subjected to continuous annealing at a temperature range of $Ac_1$° C. or more and ($Ac_3$+100)° C. or less. When the annealing temperature range is less than $Ac_1$° C., austenite transformation does not take place sufficiently, and the required area ratio of the hard structure composed of bainite and martensite cannot be secured, so the annealing temperature range is preferably $Ac_1$° C. or more, and more preferably ($Ac_1$+10)° C. or more.

Here, $Ac_1$ and $Ac_3$ are the temperatures defined from components of each steel, and when "% element" is a content of the element (mass %), for example, "% Mn" is the Mn content (mass %), $Ac_1$ and $Ac_3$ are expressed by the following expressions 1 and 2, respectively.

$$Ac_1(°\ C.)=723-10.7(\%\ Mn)-16.9(\%\ Ni)+29.1(\%\ Si)+16.9(\%\ Cr) \quad \text{(expression 1)}$$

$$Ac_3(°\ C.)=910-203(\%\ C)^{1/2}-15.2(\%\ Ni)+44.7(\%\ Si)+104(\%\ V)+31.5\ (\%\ Mo) \quad \text{(expression 2)}$$

On the other hand, when the annealing temperature range exceeds ($Ac_3$+100)° C., not only decreases productivity but also decreases ductility due to coarsened austenite grains making it harder to form ferrite, so the annealing temperature range is preferably ($Ac_3$+100)° C. or less, and more preferably ($Ac_3$+50)° C. or less.

The annealing time is preferably 60 seconds or more, and more preferably 240 seconds or more to eliminate non-recrystallization and to stably secure a homogeneous structure.

To secure the required area ratio of ferrite, the steel sheet is preferably cooled after annealing at an average cooling rate of 2° C./sec or more and 10° C./sec or less in a temperature range of 550° C. or more and $Ac_1$° C. or less. To secure the ductility of bainite and martensite and to improve the hole-expandability, the steel sheet is preferably cooled from the above temperature range to a temperature range of 200° C. or more and 350° C. or less at an average cooling rate of 35° C./sec or more, and then held at a temperature range of 200° C. or more and 550° C. or less for 200 seconds or more.

EXAMPLES

Next, examples of the present invention will be explained, but conditions in the examples are one example of conditions employed to confirm feasibility and effect of the present invention, and the present invention is not limited to the example of conditions. The present invention can employ various conditions within a range not departing from the gist of the present invention and achieving the object of the present invention.

Example 1

Molten steels with chemical compositions listed in Table 1 were cast to produce slabs to be subjected to hot rolling.

TABLE 1

| STEEL | CHEMICAL COMPOSITION (UNIT: MASS %, BALANCE: Fe AND IMPURITIES) | | | | | | | | $Ac_1$ | $Ac_3$ |
|---|---|---|---|---|---|---|---|---|---|---|
| MATERIAL | C | Si | Mn | P | S | Al | N | OTHERS | (° C.) | (° C.) |
| A | 0.03 | 1.00 | 2.00 | 0.01 | 0.002 | 0.03 | 0.003 | | 731 | 920 |
| B | 0.07 | 1.20 | 2.60 | 0.01 | 0.002 | 0.03 | 0.003 | Ti: 0.03 | 730 | 910 |
| C | 0.12 | 0.08 | 2.20 | 0.01 | 0.002 | 0.03 | 0.003 | Ti: 0.03 | 702 | 843 |
| D | 0.20 | 1.30 | 1.70 | 0.01 | 0.002 | 0.03 | 0.003 | | 743 | 877 |
| E | 0.07 | 0.02 | 1.60 | 0.01 | 0.002 | 0.03 | 0.003 | Cr: 0.07 | 706 | 857 |
| F | 0.07 | 0.20 | 1.20 | 0.01 | 0.002 | 0.03 | 0.003 | | 716 | 865 |
| G | 0.09 | 1.00 | 2.30 | 0.01 | 0.002 | 0.03 | 0.003 | Nb: 0.03 | 727 | 894 |
| H | 0.11 | 1.10 | 2.00 | 0.01 | 0.002 | 0.03 | 0.003 | V: 0.02 | 734 | 892 |
| I | 0.12 | 1.00 | 1.80 | 0.01 | 0.002 | 0.03 | 0.003 | Cr: 0.5 | 733 | 884 |
| J | 0.12 | 0.80 | 1.80 | 0.01 | 0.002 | 0.03 | 0.003 | Mo: 0.1 | 727 | 875 |
| K | 0.09 | 0.70 | 2.10 | 0.01 | 0.002 | 0.03 | 0.003 | Cu: 0.12 | 721 | 880 |
| L | 0.10 | 1.20 | 2.00 | 0.01 | 0.002 | 0.03 | 0.003 | Ni: 0.1 | 737 | 899 |
| M | 0.12 | 1.00 | 2.20 | 0.01 | 0.002 | 0.03 | 0.003 | Ca: 0.002 | 729 | 884 |
| N | 0.13 | 1.00 | 2.00 | 0.01 | 0.002 | 0.03 | 0.003 | Mg: 0.002 | 731 | 882 |
| O | 0.10 | 0.50 | 2.00 | 0.01 | 0.002 | 0.03 | 0.003 | REM: 0.002 | 716 | 868 |
| P | 0.09 | 1.00 | 2.00 | 0.01 | 0.002 | 0.03 | 0.003 | Zr: 0.002 | 731 | 894 |
| Q | 0.18 | 1.50 | 2.80 | 0.01 | 0.002 | 0.03 | 0.003 | Ti: 0.03<br>Mo: 0.2 | 737 | 891 |
| R | 0.06 | 0.08 | 3.20 | 0.01 | 0.002 | 0.03 | 0.003 | Ti: 0.02 | 691 | 864 |
| S | 0.12 | 3.30 | 1.80 | 0.01 | 0.002 | 0.03 | 0.003 | | 800 | 987 |
| T | 0.11 | 5.4 | 5.8 | 0.01 | 0.002 | 0.03 | 0.003 | Ni: 2.2 | 818 | 1084 |
| U | 0.08 | 3.3 | 9.6 | 0.01 | 0.002 | 0.03 | 0.003 | Cr: 0.1<br>REM: 0.05 | 716 | 1000 |
| V | 0.10 | 1.10 | 2.50 | 0.01 | 0.002 | 0.03 | 0.003 | Nb: 0.03 | 728 | 895 |
| W | 0.09 | 1.20 | 2.10 | 0.01 | 0.002 | 0.03 | 0.003 | W: 0.005<br>B: 0.0002 | 735 | 903 |

Some of the samples from among the slabs having the chemical compositions listed in Table 1 were subjected to a "multi-axis rolling process", where the slab before the rough-rolling process was subjected to a multi-axis rolling three times performing a compression process by 35% from a width direction and then the compression process by 35% from a thickness direction. Next, rough rolling and finish rolling processes were carried out according to hot-rolling conditions listed in Table 2. Here, in the case of the rough rolling by unidirectional rolling (Sample material 5), the total number of passes in the rough rolling was denoted in the "number of rolling times of rough rolling", and a maximum reduction ratio difference between former and latter two passes in unidirectional rolling was denoted in a "maximum reduction ratio difference between two passes in one reciprocation". After the hot rolling process, cold rolling and continuous annealing were carried out under conditions listed in Table 3 to produce the steel sheets. In Table 3, an "average cooling rate*1" in the continuous annealing process is an average cooling rate in the temperature range of 550° C. or more and $Ac_1$° C. or less, and an "average cooling rate*2" is an average cooling rate from the temperature range of $Ac_1$° C. or less to the temperature range of 200° C. or more and 350° C. or less (up to a cooling stop temperature).

TABLE 2

| SAMPLE MATERIAL No. | STEEL TYPE | HOT-ROLLING CONDITION | | | | | |
|---|---|---|---|---|---|---|---|
| | | SOLUTION TEMPERATURE (° C.) | ROUGH-ROLLING METHOD | NUMBER OF ROLLING TIMES OF ROUGH ROLLING (NUMBER OF TIMES OF RECIPROCATION) | FINAL PASS REDUCTION RATIO AFTER REVERSE ROLLING (%) | MAXIMUM REDUCTION RATIO AT ROUGH ROLLING TIME (%) | MAXIMUM REDUCTION RATIO DIFFERENCE BETWEEN TWO PASSES IN ONE RECIPROCATION (%) |
| 1 | A | 1250 | REVERSE | 4 | 0 | 28 | 5 |
| 2 | B | 1250 | REVERSE | 3 | 0 | 28 | 5 |
| 3 | C | 1250 | REVERSE | 4 | 2 | 28 | 4 |
| 4 | R | 1250 | REVERSE | 4 | 2 | 28 | 4 |
| 5 | C | 1250 | UNI-DIREC-TION | 3 | 10 | 30 | 5 |
| 6 | C | 1250 | REVERSE | 4 | 0 | 40 | 5 |
| 7 | C | 1250 | REVERSE | 4 | 2 | 28 | 5 |
| 8 | C | 1250 | REVERSE | 4 | 0 | 28 | 5 |
| 9 | D | 1250 | REVERSE | 2 | 2 | 28 | 5 |
| 10 | D | 1250 | REVERSE | 4 | 3 | 28 | 5 |
| 11 | E | 1250 | REVERSE | 4 | 0 | 28 | 5 |
| 12 | F | 1250 | REVERSE | 4 | 0 | 28 | 7 |
| 13 | G | 1250 | REVERSE | 4 | 0 | 28 | 5 |
| 14 | H | 1250 | REVERSE | 4 | 0 | 28 | 5 |
| 15 | I | 1250 | REVERSE | 4 | 2 | 28 | 5 |
| 16 | J | 1250 | REVERSE | 4 | 1 | 28 | 5 |
| 17 | K | 1250 | REVERSE | 4 | 0 | 28 | 2 |
| 18 | L | 1250 | REVERSE | 4 | 3 | 28 | 5 |
| 19 | M | 1250 | REVERSE | 4 | 0 | 28 | 6 |
| 20 | N | 1250 | REVERSE | 4 | 0 | 28 | 5 |
| 21 | O | 1250 | REVERSE | 4 | 1 | 28 | 6 |
| 22 | P | 1250 | REVERSE | 4 | 0 | 28 | 3 |
| 23 | Q | 1250 | REVERSE | 4 | 2 | 28 | 4 |
| 24 | R | 1250 | REVERSE | 3 | 0 | 28 | 5 |
| 25 | S | 1250 | REVERSE | 4 | 0 | 28 | 3 |
| 26 | T | 1250 | REVERSE | 4 | 1 | 28 | 5 |
| 27 | U | 1250 | REVERSE | 4 | 0 | 28 | 5 |
| 28 | V | 1250 | REVERSE | 4 | 20 | 25 | 5 |
| 29 | H | 1250 | REVERSE | 4 | 3 | 28 | 5 |
| 30 | D | 1250 | REVERSE | 6 | 0 | 28 | 5 |
| 31 | K | 1250 | REVERSE | 4 | 0 | 28 | 5 |
| 32 | L | 1250 | REVERSE | 4 | 0 | 28 | 5 |
| 33 | M | 1250 | REVERSE | 4 | 3 | 28 | 3 |
| 34 | O | 1250 | REVERSE | 4 | 3 | 28 | 5 |
| 35 | P | 1250 | REVERSE | 4 | 0 | 28 | 5 |
| 36 | W | 1250 | REVERSE | 4 | 1 | 28 | 5 |
| 37 | C | 1250 | REVERSE | 4 | 2 | 28 | 12 |

| SAMPLE MATERIAL No. | HOT-ROLLING CONDITION | | | | | REMARKS |
|---|---|---|---|---|---|---|
| | ROUGH ROLLING START TEMPERATURE (° C.) | ROUGH ROLLING COMPLETION TEMPERATURE (° C.) | FINISH ROLLING START TEMPERATURE (° C.) | FINISH ROLLING COMPLETION TEMPERATURE (° C.) | COILING TEMPERATURE (° C.) | |
| 1 | 1220 | 1170 | 1115 | 930 | 620 | COMPARATIVE EXAMPLE |
| 2 | 1200 | 1150 | 1110 | 910 | 600 | EXAMPLE |
| 3 | 1200 | 1150 | 1100 | 900 | 620 | EXAMPLE |
| 4 | 1200 | 1150 | 1100 | 900 | 600 | EXAMPLE |
| 5 | 1200 | 1150 | 1100 | 900 | 600 | COMPARATIVE EXAMPLE |
| 6 | 1200 | 1150 | 1050 | 870 | 600 | COMPARATIVE EXAMPLE |
| 7 | 1150 | 970 | 870 | 780 | 600 | COMPARATIVE EXAMPLE |
| 8 | 1150 | 1150 | 1100 | 900 | 600 | COMPARATIVE EXAMPLE |
| 9 | 1200 | 1150 | 1100 | 900 | 400 | EXAMPLE |
| 10 | 1200 | 1150 | 1100 | 900 | 600 | COMPARATIVE EXAMPLE |

TABLE 2-continued

| | | | | | | |
|---|---|---|---|---|---|---|
| 11 | 1200 | 1150 | 1100 | 900 | 600 | COMPARATIVE EXAMPLE |
| 12 | 1200 | 1150 | 1100 | 900 | 600 | COMPARATIVE EXAMPLE |
| 13 | 1200 | 1150 | 1100 | 900 | 620 | EXAMPLE |
| 14 | 1200 | 1150 | 1100 | 900 | 620 | EXAMPLE |
| 15 | 1200 | 1150 | 1100 | 900 | 620 | EXAMPLE |
| 16 | 1200 | 1150 | 1100 | 900 | 620 | EXAMPLE |
| 17 | 1200 | 1150 | 1100 | 900 | 620 | EXAMPLE |
| 18 | 1200 | 1150 | 1100 | 900 | 620 | EXAMPLE |
| 19 | 1200 | 1150 | 1100 | 900 | 620 | EXAMPLE |
| 20 | 1200 | 1150 | 1100 | 900 | 620 | EXAMPLE |
| 21 | 1200 | 1150 | 1100 | 900 | 620 | EXAMPLE |
| 22 | 1200 | 1150 | 1100 | 900 | 620 | EXAMPLE |
| 23 | 1200 | 1150 | 1100 | 900 | 400 | EXAMPLE |
| 24 | 1200 | 1150 | 1100 | 900 | 620 | EXAMPLE |
| 25 | 1250 | 1150 | 1140 | 990 | 620 | EXAMPLE |
| 26 | 1250 | 1150 | 1140 | 1030 | 650 | EXAMPLE |
| 27 | 1250 | 1150 | 1140 | 980 | 650 | EXAMPLE |
| 28 | 1250 | 1150 | 1100 | 900 | 600 | COMPARATIVE EXAMPLE |
| 29 | 1200 | 1150 | 1050 | 900 | 620 | EXAMPLE |
| 30 | 1200 | 1150 | 1100 | 900 | 600 | EXAMPLE |
| 31 | 1200 | 1150 | 1100 | 900 | 600 | EXAMPLE |
| 32 | 1200 | 1150 | 1100 | 900 | 620 | EXAMPLE |
| 33 | 1200 | 1150 | 1100 | 900 | 610 | EXAMPLE |
| 34 | 1200 | 1150 | 1100 | 900 | 600 | EXAMPLE |
| 35 | 1200 | 1150 | 1100 | 900 | 600 | EXAMPLE |
| 36 | 1200 | 1150 | 1100 | 900 | 400 | EXAMPLE |
| 37 | 1200 | 1150 | 1100 | 900 | 620 | COMPARATIVE EXAMPLE |

TABLE 3

| | COLD ROLLING | | CONTINUOUS ANNEALING PROCESS | | | | |
|---|---|---|---|---|---|---|---|
| SAMPLE MATERIAL No. | REDUCTION RATIO (%) | FINISHED SHEET THICKNESS (mm) | TEMPERATURE INCREASING RATE (° C./s) | MAXIMUM HEATING TEMPERATURE AT ANNEALING TIME (° C.) | ANNEALING TIME (s) | COOLING TEMPERATURE AFTER MAXIMUM HEATING (° C.) | AVERAGE COOLING RATE*1 (° C./s) |
| 1 | 58 | 1.0 | 2 | 920 | 200 | 600 | 2.3 |
| 2 | 58 | 1.0 | 2 | 880 | 200 | 660 | 2.3 |
| 3 | 58 | 1.0 | 2 | 880 | 200 | 670 | 2.3 |
| 4 | 58 | 1.0 | 2 | 880 | 200 | 650 | 2.3 |
| 5 | 58 | 1.0 | 2 | 880 | 200 | 660 | 2.0 |
| 6 | 58 | 1.0 | 2 | 850 | 220 | 650 | 2.3 |
| 7 | 58 | 1.0 | 2 | 850 | 200 | 650 | 2.3 |
| 8 | 58 | 1.0 | 2 | 700 | 200 | 600 | 2.3 |
| 9 | 58 | 1.0 | 2 | 880 | 200 | 660 | 2.5 |
| 10 | 58 | 1.0 | 2 | 980 | 200 | 720 | 2.3 |
| 11 | 58 | 1.0 | 2 | 850 | 200 | 600 | 1.5 |
| 12 | 58 | 1.0 | 2 | 850 | 200 | 600 | 1.5 |
| 13 | 58 | 1.0 | 2 | 880 | 200 | 620 | 2.3 |
| 14 | 58 | 1.0 | 2 | 880 | 200 | 610 | 2.3 |
| 15 | 58 | 1.0 | 2 | 880 | 200 | 600 | 2.3 |
| 16 | 58 | 1.0 | 2 | 880 | 200 | 600 | 2.3 |
| 17 | 58 | 1.0 | 2 | 880 | 200 | 620 | 2.3 |
| 18 | 58 | 1.0 | 2 | 880 | 200 | 600 | 2.3 |
| 19 | 58 | 1.0 | 2 | 880 | 200 | 610 | 2.3 |
| 20 | 58 | 1.0 | 2 | 880 | 200 | 615 | 2.3 |
| 21 | 58 | 1.0 | 2 | 880 | 200 | 630 | 2.3 |
| 22 | 58 | 1.0 | 2 | 880 | 200 | 620 | 2.3 |
| 23 | 58 | 1.0 | 2 | 870 | 200 | 600 | 2.3 |
| 24 | 58 | 1.0 | 2 | 880 | 200 | 600 | 2.3 |
| 25 | 58 | 1.0 | 2 | 1000 | 200 | 720 | 2.3 |
| 26 | 58 | 1.0 | 2 | 900 | 600 | 600 | 2.3 |
| 27 | 58 | 1.0 | 2 | 860 | 500 | 600 | 2.3 |
| 28 | 58 | 1.0 | 2 | 900 | 200 | 600 | 2.3 |
| 29 | 58 | 1.0 | 2 | 900 | 200 | 625 | 2.3 |
| 30 | 58 | 1.0 | 2 | 880 | 200 | 650 | 4.2 |
| 31 | 58 | 1.0 | 2 | 910 | 200 | 650 | 2.3 |
| 32 | 58 | 1.0 | 2 | 870 | 200 | 660 | 2.3 |
| 33 | 58 | 1.0 | 2 | 900 | 200 | 650 | 2.3 |

TABLE 3-continued

| | | | | | | | |
|---|---|---|---|---|---|---|---|
| 34 | 58 | 1.0 | 2 | 910 | 200 | 670 | 2.3 |
| 35 | 58 | 1.0 | 2 | 900 | 200 | 660 | 2.3 |
| 36 | 58 | 1.0 | 2 | 900 | 200 | 600 | 2.3 |
| 37 | 55 | 1.2 | 2 | 900 | 200 | 650 | 2.0 |

| | CONTINUOUS ANNEALING PROCESS | | | | | |
|---|---|---|---|---|---|---|
| SAMPLE MATERIAL No. | AVERAGE COOLING RATE*2 (° C./s) | COOLING STOP TEMPERATURE (° C.) | LOW TEMPERATURE HOLDING TEMPERATURE (° C.) | LOW TEMPERATURE HOLDING TIME (s) | COOLING RATE AFTER LOW TEMPERATURE HOLDING (° C./s) | REMARKS |
| 1 | 40 | 300 | 300 | 300 | 0.75 | COMPARATIVE EXAMPLE |
| 2 | 40 | 300 | 300 | 300 | 0.75 | EXAMPLE |
| 3 | 40 | 300 | 300 | 300 | 0.75 | EXAMPLE |
| 4 | 40 | 300 | 300 | 300 | 0.75 | EXAMPLE |
| 5 | 40 | 300 | 300 | 300 | 0.75 | COMPARATIVE EXAMPLE |
| 6 | 40 | 300 | 300 | 300 | 0.75 | COMPARATIVE EXAMPLE |
| 7 | 40 | 300 | 300 | 300 | 0.75 | COMPARATIVE EXAMPLE |
| 8 | 40 | 300 | 300 | 300 | 0.75 | COMPARATIVE EXAMPLE |
| 9 | 40 | 300 | 300 | 300 | 0.75 | EXAMPLE |
| 10 | 40 | 300 | 300 | 300 | 0.75 | COMPARATIVE EXAMPLE |
| 11 | 30 | 300 | 300 | 300 | 0.75 | COMPARATIVE EXAMPLE |
| 12 | 30 | 300 | 300 | 300 | 0.75 | COMPARATIVE EXAMPLE |
| 13 | 40 | 300 | 300 | 300 | 0.75 | EXAMPLE |
| 14 | 40 | 300 | 300 | 300 | 0.75 | EXAMPLE |
| 15 | 40 | 300 | 300 | 300 | 0.75 | EXAMPLE |
| 16 | 40 | 300 | 300 | 300 | 0.75 | EXAMPLE |
| 17 | 40 | 300 | 300 | 300 | 0.75 | EXAMPLE |
| 18 | 40 | 300 | 300 | 300 | 0.75 | EXAMPLE |
| 19 | 40 | 300 | 300 | 300 | 0.75 | EXAMPLE |
| 20 | 40 | 300 | 300 | 300 | 0.75 | EXAMPLE |
| 21 | 40 | 300 | 300 | 300 | 0.75 | EXAMPLE |
| 22 | 40 | 300 | 300 | 300 | 0.75 | EXAMPLE |
| 23 | 40 | 200 | 200 | 300 | 0.75 | EXAMPLE |
| 24 | 40 | 300 | 300 | 300 | 0.75 | EXAMPLE |
| 25 | 40 | 300 | 300 | 300 | 0.75 | EXAMPLE |
| 26 | 40 | 200 | 400 | 300 | 0.75 | EXAMPLE |
| 27 | 40 | 250 | 450 | 300 | 0.75 | EXAMPLE |
| 28 | 40 | 250 | 450 | 300 | 0.75 | COMPARATIVE EXAMPLE |
| 29 | 40 | 300 | 320 | 300 | 0.75 | EXAMPLE |
| 30 | 40 | 350 | 350 | 300 | 0.75 | EXAMPLE |
| 31 | 40 | 300 | 300 | 300 | 0.75 | EXAMPLE |
| 32 | 40 | 300 | 320 | 300 | 0.75 | EXAMPLE |
| 33 | 40 | 300 | 300 | 300 | 0.75 | EXAMPLE |
| 34 | 40 | 300 | 300 | 300 | 0.75 | EXAMPLE |
| 35 | 40 | 300 | 300 | 300 | 0.75 | EXAMPLE |
| 36 | 40 | 200 | 350 | 300 | 0.75 | EXAMPLE |
| 37 | 40 | 300 | 250 | 300 | 0.75 | COMPARATIVE EXAMPLE |

The following tests and observations were carried out on the annealed steel sheet (hereinafter simply referred to as a "steel sheet"). The results are summarized in Table 4.

(1) Tensile Test

A JIS No. 5 tensile test piece was taken from the steel sheet with a direction perpendicular to a rolling direction as a longitudinal direction, and tensile properties (yield strength YS, tensile strength TS, and total elongation El) were measured by the tensile test based on JIS Z 2241.

(2) Hole-Expanding Test

A test piece of 90 mm square was taken from the steel sheet, and the hole-expanding test based on the definition in JIS Z 2256 was carried out at a test speed of 1 mm/sec to investigate the hole-expandability.

External appearance was visually inspected at the time of steel sheet manufacturing. The external appearance inspection was carried out by the following methods. First, 10 steel sheets of 1 m wide×1 mm long region were taken from any region of the manufactured steel sheet with an interval of 1 m or more in a longitudinal direction, and each surface was degreased, washed, and made a test piece. When the surface of each test piece was observed visually, and one or more coarse linear flaws of 0.2 mm or more in width and 50 mm or more in length were observed in all ten test pieces, a surface property was judged to be defective. When the coarse surface flaw of 0.2 mm or more in width and 50 mm or more in length was not observed, but one or more surface flaws of 0.2 mm or more in width and 10 mm or more and less than 50 mm in length were observed on the surface of the test piece, the surface property was judged to be good. When a coarse linear pattern of 0.2 mm or more in width and 10 mm or more in length was not observed on the surface of the test piece, the surface property was judged to be superior. The results are listed in Table 4.

External appearance was visually inspected at the time of steel sheet manufacturing. The external appearance inspection was carried out by the following methods. First, 10 steel sheets of 1 m wide×1 mm long region were taken from any region of the manufactured steel sheet with an interval of 1 m or more in a longitudinal direction, and each surface was degreased, washed, and made a test piece. When the surface of each test piece was observed visually, and one or more coarse linear patterns of 0.2 mm or more in width and 10 mm or more in length were observed in all ten test pieces, a surface property was judged to be defective. When the coarse linear pattern of 0.2 mm or more in width and 10 mm or more in length was not observed on the surface of the test piece, the surface property was judged to be good.

External appearance was visually inspected at the time of forming. The external appearance inspection was carried out by the following methods. First, the steel sheet was cut into 40 mm width×100 mm length, and each surface was polished until metallic luster was seen, and made a test piece. The test piece was subjected to a 90-degree V-bending test with two levels where a ratio (R/t) of a sheet thickness t to a bend radius R was 2.0 and 2.5, and under a condition that a bending edge line was in a rolling direction. After the test, a surface property of the bent part was visually observed. When unevenness or cracking was observed on the surface in the test with the ratio (R/t) of 2.5, it was judged to be defective. When no unevenness or cracking was observed in the test with the ratio (R/t) of 2.5, but unevenness or cracking was observed on the surface in the test with the ratio (R/t) of 2.0, it was judged to be good. When no unevenness or cracking was observed on the surface in both the test with the ratio (R/t) of 2.5 and the test with the ratio (R/t) of 2.0, it was judged to be superior. These results are also listed in Table 4.

(3) Structure Observation

Regarding the structure of the steel sheet, a sheet thickness cross-section parallel to a rolling direction is corroded by LePera etching at a position of ¼ of a width of the steel sheet. Next, the sheet thickness cross-section at a region from 3t/8 to t/2 in depth from a surface of the steel sheet is photographed by using an optical microscope. At this time, a magnification is set to, for example, 500 times. An observed surface can be approximately distinguished into black and white portions by the corrosion using the LePera etchant. The black portions may contain ferrite, bainite, carbide, and perlite. Within the black portion, a portion that contains a lamellar structure within a grain corresponds to perlite. Within the black portion, a portion that does not contain any lamellar structure or substructure within the grain corresponds to ferrite. Within the black portion, a portion that is spherical with a diameter of about 1 μm to 5 μm with a particularly low brightness corresponds to carbide. Within the black portion, a portion that contains the substructure within the grain corresponds to bainite. Accordingly, an area ratio of ferrite can be obtained by measuring an area ratio of the black portions which contain neither the lamellar structure nor the substructure within the grain, and an area ratio of bainite can be obtained by measuring an area ratio of the black portions which contain the substructure within the grain. An area ratio of the white portion is a total area ratio of martensite and retained austenite. Accordingly, an area ratio of the hard structure can be obtained from the area ratio of bainite and the total area ratio of martensite and retained austenite. The maximum coupled ferrite region and the two-dimensional isoperimetric constant thereof were calculated from the optical micrograph.

The maximum coupled ferrite region is the ferrite region with the highest area that is continuously coupled without being broken up by the hard structure in the structure of the steel sheet. The area ratio and the two-dimensional isoperimetric constant thereof are calculated by the following method.

(3-1) Area Ratio of Maximum Coupled Ferrite Region to Total Ferrite Region

A structural image at the magnification of 500 times in the region from the position at the depth of 3t/8 from the steel sheet surface to the position at the depth of t/2 (t: sheet thickness of steel sheet) is binarized using the above method. A region having the maximum number of pixels is identified as the maximum coupled ferrite region out of the regions where one pixel indicating the ferrite region in the binarized image is set as a center, and pixels adjacent thereto in four directions of top, bottom, left and right in the ferrite region are coupled.

The area ratio $R_F$ of the maximum coupled ferrite region to the total ferrite region is obtained by finding the area $S_M$ of the maximum coupled ferrite region and calculating from the ratio to the area $S_F$ of the total ferrite area: $R_F=S_M/S_F$.

(3-2) Two-Dimensional Isoperimetric Constant

The two-dimensional isoperimetric constant K of the maximum coupled ferrite region is calculated according to the following expression by using the area $S_M$ and the peripheral length $L_M$ of the maximum coupled ferrite region.

$$K=4\pi S_M/L_M^2 \text{ (π: circumference ratio)}$$

TABLE 4

| | MECHANICAL PROPERTY VALUE | | | | STEEL STRUCTURE | | | | |
|---|---|---|---|---|---|---|---|---|---|
| SAMPLE MATERIAL No. | TS (MPa) | EL (%) | HOLE EXPANSION RATIO (%) | EXTERNAL APPEARANCE INSPECTION RESULT | FERRITE AREA RATIO (%) | HARD STRUCTURE AREA RATIO*4 (%) | AREA RATIO OF MAXIMUM COUPLED FERRITE (%) | ISOPERIMETRIC CONSTANT OF MAXIMUM COUPLED FERRITE | REMARKS |
| 1 | 587 | 32.3 | 56 | SUPERIOR | 89.3 | 9.3 | 99.9 | 0.34 | COMPARATIVE EXAMPLE |
| 2 | 815 | 22.7 | 44.3 | SUPERIOR | 71.1 | 28.3 | 99.7 | 0.27 | EXAMPLE |
| 3 | 970 | 16.1 | 42.6 | GOOD | 38 | 61.2 | 99.7 | 0.22 | EXAMPLE |

TABLE 4-continued

| SAMPLE MATERIAL No. | MECHANICAL PROPERTY VALUE TS (MPa) | EL (%) | HOLE EXPANSION RATIO (%) | EXTERNAL APPEARANCE INSPECTION RESULT | STEEL STRUCTURE FERRITE AREA RATIO (%) | HARD STRUCTURE AREA RATIO*4 (%) | AREA RATIO OF MAXIMUM COUPLED FERRITE (%) | ISOPERIMETRIC CONSTANT OF MAXIMUM COUPLED FERRITE | REMARKS |
|---|---|---|---|---|---|---|---|---|---|
| 4 | 1038 | 14.7 | 31.6 | GOOD | 50.1 | 49.3 | 99.8 | 0.32 | EXAMPLE |
| 5 | 893 | 18.3 | 26.5 | DEFECTIVE | 59.1 | 38.3 | 44.8 | 0.42 | COMPARATIVE EXAMPLE |
| 6 | 983 | 14.3 | 22.1 | DEFECTIVE | 49.1 | 48.5 | 53.2 | 0.43 | COMPARATIVE EXAMPLE |
| 7 | 1080 | 11.4 | 19.6 | GOOD | 41.2 | 58.3 | 59.8 | 0.36 | COMPARATIVE EXAMPLE |
| 8 | 589 | 30.1 | 76.3 | SUPERIOR | 84.7 | 2.3 | 99.9 | 0.34 | COMPARATIVE EXAMPLE |
| 9 | 1068 | 15.2 | 31.3 | GOOD | 45.2 | 50.8 | 99.6 | 0.29 | EXAMPLE |
| 10 | 1438 | 6.5 | 28.3 | GOOD | 7.3 | 82.1 | 13.3 | 0.01 | COMPARATIVE EXAMPLE |
| 11 | 715 | 26.8 | 43.8 | SUPERIOR | 78.3 | 19.6 | 99.9 | 0.32 | COMPARATIVE EXAMPLE |
| 12 | 693 | 27.3 | 48 | SUPERIOR | 79.1 | 20.3 | 99.9 | 0.33 | COMPARATIVE EXAMPLE |
| 13 | 970 | 21.3 | 31.5 | SUPERIOR | 72.4 | 26.3 | 99.7 | 0.31 | EXAMPLE |
| 14 | 819 | 21.4 | 31.1 | SUPERIOR | 70.5 | 26.0 | 99.4 | 0.3 | EXAMPLE |
| 15 | 915 | 17.8 | 32.1 | GOOD | 65.9 | 32.2 | 98.9 | 0.29 | EXAMPLE |
| 16 | 926 | 16.9 | 31 | GOOD | 65.1 | 31.8 | 99.8 | 0.29 | EXAMPLE |
| 17 | 862 | 20.1 | 35.9 | SUPERIOR | 67.3 | 30.6 | 99.1 | 0.24 | EXAMPLE |
| 18 | 840 | 19.3 | 36.2 | GOOD | 67.4 | 29.2 | 99.7 | 0.23 | EXAMPLE |
| 19 | 898 | 17.4 | 30.3 | SUPERIOR | 69.7 | 28.4 | 99.4 | 0.26 | EXAMPLE |
| 20 | 928 | 17.3 | 32.6 | SUPERIOR | 62.2 | 34.0 | 98.8 | 0.31 | EXAMPLE |
| 21 | 870 | 16.2 | 37 | GOOD | 65.9 | 32.5 | 99.6 | 0.32 | EXAMPLE |
| 22 | 824 | 20.5 | 38.4 | SUPERIOR | 71.6 | 27.1 | 99.7 | 0.24 | EXAMPLE |
| 23 | 1181 | 13.4 | 35.1 | GOOD | 27.6 | 72.1 | 99.8 | 0.29 | EXAMPLE |
| 24 | 903 | 18.3 | 31.1 | GOOD | 73.5 | 26.3 | 99.9 | 0.26 | EXAMPLE |
| 25 | 991 | 14.6 | 30.5 | SUPERIOR | 68.2 | 31.2 | 99.5 | 0.27 | EXAMPLE |
| 26 | 1113 | 13.1 | 33 | GOOD | 46.9 | 53.0 | 83.1 | 0.29 | EXAMPLE |
| 27 | 1093 | 14.8 | 36.1 | GOOD | 39.6 | 58.6 | 86.4 | 0.31 | EXAMPLE |
| 28 | 1025 | 10.3 | 29.3 | DEFECTIVE | 61.3 | 37.9 | 57.1 | 0.36 | COMPARATIVE EXAMPLE |
| 29 | 911 | 16.3 | 30.4 | GOOD | 69.7 | 29.9 | 99.5 | 0.31 | EXAMPLE |
| 30 | 883 | 16.5 | 61.3 | SUPERIOR | 62.1 | 37.2 | 99.3 | 0.31 | EXAMPLE |
| 31 | 933 | 17.5 | 33.1 | SUPERIOR | 62.7 | 36.9 | 99.4 | 0.28 | EXAMPLE |
| 32 | 921 | 15.3 | 34.3 | SUPERIOR | 62.7 | 36.7 | 99.1 | 0.26 | EXAMPLE |
| 33 | 918 | 16.6 | 35.2 | GOOD | 64.4 | 35.3 | 99.5 | 0.24 | EXAMPLE |
| 34 | 935 | 12.6 | 31.5 | GOOD | 62.7 | 37.1 | 99.2 | 0.30 | EXAMPLE |
| 35 | 926 | 17.1 | 36.9 | SUPERIOR | 64.3 | 35.1 | 99.4 | 0.29 | EXAMPLE |
| 36 | 1177 | 12.1 | 33.5 | GOOD | 56.3 | 43.1 | 99.6 | 0.26 | EXAMPLE |
| 37 | 988 | 12.1 | 27.5 | DEFECTIVE | 43 | 55 | 78.3 | 0.42 | COMPARATIVE EXAMPLE |

In Tables 1 to 4, the underlined values indicate that they are out of the range of the present invention or out of the range of the preferred manufacturing conditions.

In Table 4, Sample materials No. 2, No. 3, No. 4, No. 9, No. 13, No. 14, No. 15, No. 16, No. 17, No. 18, No. 19, No. 20, No. 21, No. 22, No. 23, No. 24, No. 25, No. 26, No. 27, No. 29, No. 30, No. 31, No. 32, No. 33, No. 34, No. 35, and No. 36 are Examples that satisfy all the conditions of the present invention.

In each of the steel sheets of Examples, the two-dimensional isoperimetric constant of the maximum coupled ferrite region in the region from the position at depth of 3t/8 from the surface to the position at depth of t/2 (t: sheet thickness of steel sheet) is 0.35 or less, and the hole-expandability is excellent in the hole expanding test with the fast test speed (processing speed) of 1 mm/sec.

On the other hand, in each of Sample materials No. 1, No. 11, and No. 12, the chemical composition is out of the chemical composition of the present invention, and the ferrite area ratio is high and area ratios of bainite and martensite are low, which are out of the range of the present invention, so the tensile strength of 780 MPa or more cannot be obtained.

The tensile strength of Sample material No. 8 is low because the area ratios of ferrite and the hard structure are out of the range of the present invention. The elongation of Sample material No. 10 is low because the area ratio of ferrite and the area ratio of the maximum coupled ferrite region are out of the range of the present invention. In Sample materials No. 5, No. 6, No. 7, No. 28, and No. 37, the area ratio and the two-dimensional isoperimetric constant of the maximum coupled ferrite region are out of the range of the present invention, and the hole-expandability is inferior.

INDUSTRIAL APPLICABILITY

As mentioned above, the high-strength steel sheet with the tensile strength of 780 MPa or more and excellent ductility and hole-expandability can be provided according to the present invention. Further, the high-strength steel sheet of the present invention is suitable for steel sheets to which press forming is applied, such as automobile bodies, and in particular for steel sheets that require ductility and stretch flange-forming, which have been difficult to apply in the past, making the present invention highly applicable in the steel sheet manufacturing and processing industries, and the automobile industry.

EXPLANATION OF CODES

1 . . . maximum coupled ferrite region
2 . . . hard structure region
3 . . . non-maximum coupled ferrite region
10 . . . slab
11 . . . Mn segregation portion

What is claimed is:

1. A steel sheet, comprising: a steel sheet with a chemical composition, in mass %, C: 0.05% or more and 0.30% or less, Si: 0.05% or more and 6.00% or less, Mn: 1.50% or more and 10.00% or less, P: 0.000% or more and 0.100% or less, S: 0.000% or more and 0.010% or less, sol. Al: 0.010% or more and 1.000% or less, N: 0.000% or more and 0.010% or less, Ti: 0.000% or more and 0.200% or less, Nb: 0.000% or more and 0.200% or less, V: 0.000% or more and 0.200% or less, Cr: 0.000% or more and 1.000% or less, Mo: 0.000% or more and 1.000% or less, Cu: 0.000% or more and 1.000% or less, Ni: 0.000% or more and 1.000% or less, Ca: 0.0000% or more and 0.0100% or less, Mg: 0.0000% or more and 0.0100% or less, REM: 0.0000% or more and 0.0100% or less, Zr: 0.0000% or more and 0.0100% or less, W: 0.0000% or more and 0.0100% or less, B: 0.0000% or more and 0.0030% or less, and the balance: Fe and inevitable impurities, wherein a structure of the steel sheet consists essentially of, in area ratio, 15% or more and 80% or less of ferrite and 20% or more and 85% or less in total of a hard structure composed of any one of bainite, martensite, or retained austenite, or any combination thereof, and an area ratio of a maximum coupled ferrite region in a region from a position at a depth of 3t/8 from a surface to a position at a depth of t/2, where t is a sheet thickness of the steel sheet, is 80% or more in area ratio to a total ferrite area, and a two-dimensional isoperimetric constant of the maximum coupled ferrite region is 0.35 or less, wherein the steel sheet has a tensile strength of 780 MPa or more, a hole expansion ratio of 30% or more, and a fracture elongation of 10% or more.

2. The steel sheet according to claim 1, wherein, in mass %, one or more of Ti: 0.003% or more and 0.200% or less, Nb: 0.003% or more and 0.200% or less, and V: 0.003% or more and 0.200% or less are contained.

3. The steel sheet according to claim 1, wherein, in mass %, one or more of Cr: 0.005% or more and 1.000% or less, Mo: 0.005% or more and 1.000% or less, Cu: 0.005% or more and 1.000% or less, and Ni: 0.005% or more and 1.000% or less are contained.

4. The steel sheet according to claim 1, wherein, in mass %, one or more of Ca: 0.0003% or more and 0.0100% or less, Mg: 0.0003% or more and 0.0100% or less, REM: 0.0003% or more and 0.0100% or less, Zr: 0.0003% or more and 0.0100% or less, and W: 0.0003% or more and 0.0050% or less are contained.

5. The steel sheet according claim 1, wherein, in mass %, B: 0.0001% or more and 0.0030% or less is contained.

6. The steel sheet according to claim 2, wherein, in mass %, one or more of Cr: 0.005% or more and 1.000% or less, Mo: 0.005% or more and 1.000% or less, Cu: 0.005% or more and 1.000% or less, and Ni: 0.005% or more and 1.000% or less are contained.

7. The steel sheet according to claim 2, wherein, in mass %, one or more of Ca: 0.0003% or more and 0.0100% or less, Mg: 0.0003% or more and 0.0100% or less, REM: 0.0003% or more and 0.0100% or less, Zr: 0.0003% or more and 0.0100% or less, and W: 0.0003% or more and 0.0050% or less are contained.

8. The steel sheet according to claim 2, wherein, in mass %, B: 0.0001% or more and 0.0030% or less is contained.

9. The steel sheet according to claim 3, wherein, in mass %, one or more of Ca: 0.0003% or more and 0.0100% or less, Mg: 0.0003% or more and 0.0100% or less, REM: 0.0003% or more and 0.0100% or less, Zr: 0.0003% or more and 0.0100% or less, and W: 0.0003% or more and 0.0050% or less are contained.

10. The steel sheet according to claim 3, wherein, in mass %, B: 0.0001% or more and 0.0030% or less is contained.

11. The steel sheet according to claim 6, wherein, in mass %, one or more of Ca: 0.0003% or more and 0.0100% or less, Mg: 0.0003% or more and 0.0100% or less, REM: 0.0003% or more and 0.0100% or less, Zr: 0.0003% or more and 0.0100% or less, and W: 0.0003% or more and 0.0050% or less are contained.

12. The steel sheet according to claim 6, wherein, in mass %, B: 0.0001% or more and 0.0030% or less is contained.

13. The steel sheet according to claim 4, wherein, in mass %, B: 0.0001% or more and 0.0030% or less is contained.

14. The steel sheet according to claim 7, wherein, in mass %, B: 0.0001% or more and 0.0030% or less is contained.

15. The steel sheet according to claim 9, wherein, in mass %, B: 0.0001% or more and 0.0030% or less is contained.

16. The steel sheet according to claim 11, wherein, in mass %, B: 0.0001% or more and 0.0030% or less is contained.

* * * * *